United States Patent [19]

Constiner et al.

[11] Patent Number: 5,051,151

[45] Date of Patent: Sep. 24, 1991

[54] SIDE EXTRACTION PULPER WITH SCREW TYPE ROTOR

[75] Inventors: Joseph P. Constiner, Monroe; Derald R. Hatton, Middletown, both of Ohio

[73] Assignee: The Black Clawson Company, Middletown, Ohio

[21] Appl. No.: 656,918

[22] Filed: Feb. 19, 1991

[51] Int. Cl.[5] ..... D21B 1/32; B02C 23/36

[52] U.S. Cl. ..... 162/264; 162/261; 241/46.17

[58] Field of Search ..... 162/261, 264, 4; 241/46.11, 46.17

[56] References Cited

U.S. PATENT DOCUMENTS

| | | | |
|---|---|---|---|
| 2,696,766 | 12/1954 | Stark | 241/45 |
| 3,073,535 | 1/1963 | Vokes | 241/46 R |
| 3,889,885 | 6/1975 | Couture | 241/46.17 |
| 4,017,033 | 4/1977 | Tra | 162/4 |
| 4,413,789 | 11/1983 | Rienecker et al. | 241/46.17 |
| 4,641,790 | 2/1987 | Musselmann et al. | 162/4 |
| 4,725,007 | 2/1988 | Chupka | 241/46.02 |

*Primary Examiner*—Karen M. Hastings

*Attorney, Agent, or Firm*—Biebel & French

[57] ABSTRACT

Apparatus for pulping a web of broke advancing downwardly thereto comprises an open tub having at least one generally vertical side wall wherein at least one pulping rotor is mounted for rotation on a substantially horizontal axis. A screw of an axial length substantially greater than the maximum axial dimension of each rotor is mounted concentrically on each rotor and extends horizontally therefrom into the interior of the tub to engage a web of broke entering the tub from above and thereby to draw the web into engagement with the associated rotor.

3 Claims, 2 Drawing Sheets

SIDE EXTRACTION PULPER WITH SCREW TYPE ROTOR

BACKGROUND OF THE INVENTION

This invention has particular relation to the handling of paper sheet in the form commonly known as "broke" which results from a break in the paper web as it is being produced on a paper machine, and the invention is especially concerned with the handling and repulping of such broke.

It has long been known to provide for the handling and repulping of broke by means of pulpers which are positioned underneath the paper machine at spaced locations where breaks in the web are likely to occur such, for example, as between the last dryer drum and the adjacent calendar stack. It is also a common practice to utilize for this purpose a pulper having an elongated but relatively narrow tub which can be positioned to extend across the width of the paper machine so that when a web break occurs, the advancing web of broke can be directed into the tub without requiring slitting, folding or redirection.

An early form of pulper for this purpose is disclosed in the co-owned Stark U.S. Pat. No. 2,696,766 of 1954. The assignee of the present invention has also marketed broke pulpers comprising an elongated open tub having mounted in one of its side walls one or more rotors of the construction shown in the co-owned Vokes U.S. Pat. No. 3,073,535 of 1963 or Couture U.S. Pat. No. 3,889,885 of 1975.

Problems have been encountered with broke pulpers of the above types in the handling of broke which has been pressed and dried sufficiently to possess significant tensile strength to behave like a sheet as compared with a newly formed web. Such broke has a tendency to pile up on top of the liquid in the tub and thereby to avoid the repulping action of the rotor or rotors submerged in the liquid in the tub. The present invention is directed to curing this problem by providing a modified pulper construction which will assure rapid subjection of any type of broke to the repulping action of the rotor or rotors within the pulper tub.

SUMMARY OF THE INVENTION

In accordance with the present invention, it has been discovered that if each rotor mounted for rotation on a horizontal axis in the side wall of an elongated broke pulper is provided with a screw which extends axially for a substantial distance beyond the rotor, broke which otherwise would tend to accumulate on top of the liquid in the tub, out of the reach of the rotor circulation pattern, will be rapidly drawn down within reach of the rotor vanes so that it can be quickly repulped and removed. This action is especially effective when each rotor is equipped with a perforated bed plate through which adequately repulped material will be continuously extracted from the tub at a rate which will enable the pulper to repulp the broke at approximately the same rate that it is supplied to the pulper until the break in the web has been repaired and the paper machine resumes its normal production course.

For a better understanding of the invention, reference is made to the detailed description which follows in conjunction with the drawings.

DESCRIPTION OF THE PREFERRED EMBODIMENT

Figure 1:
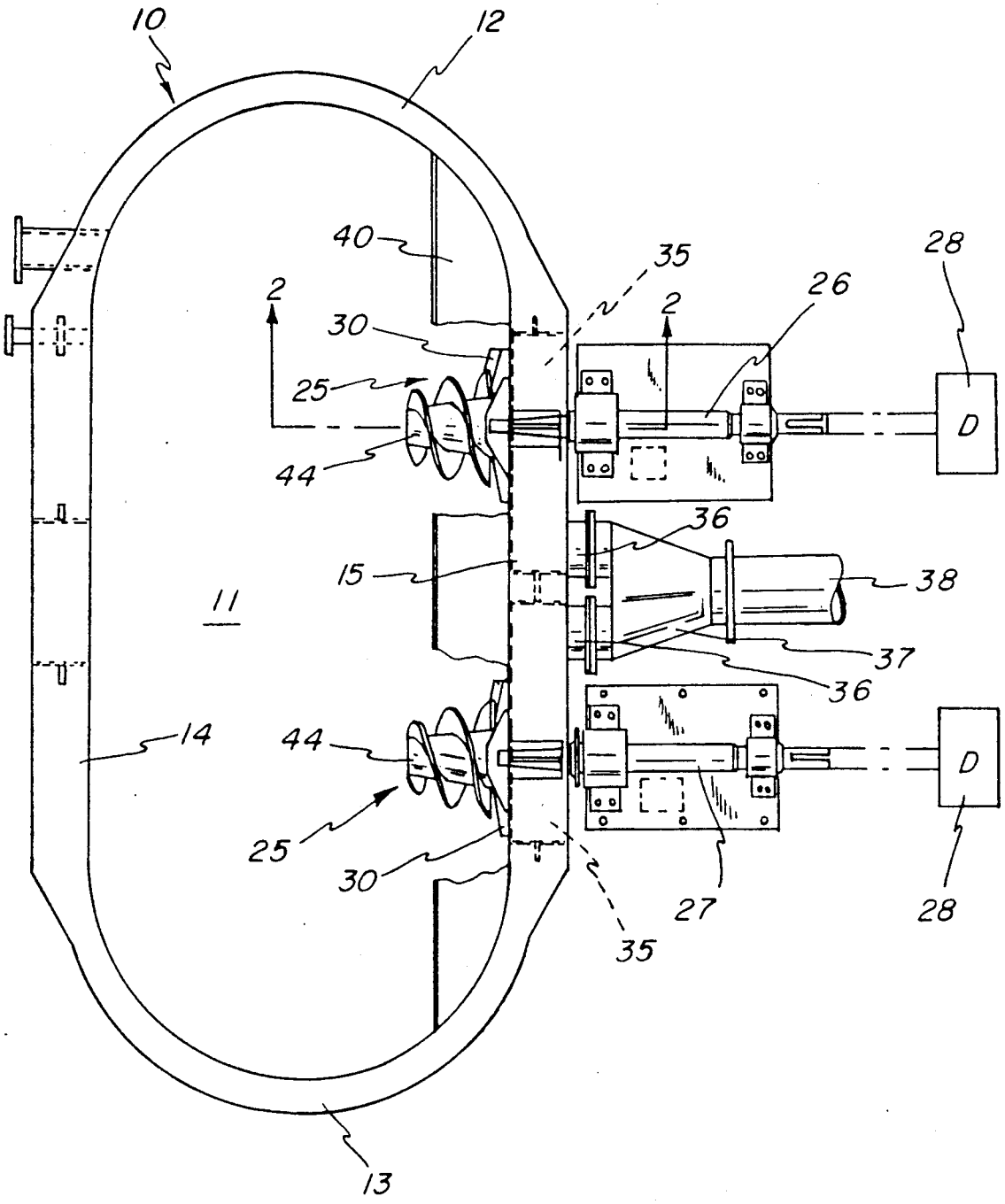
FIG. 1 is a plan view showing a pulper constructed in accordance with the invention.
Figure 2:
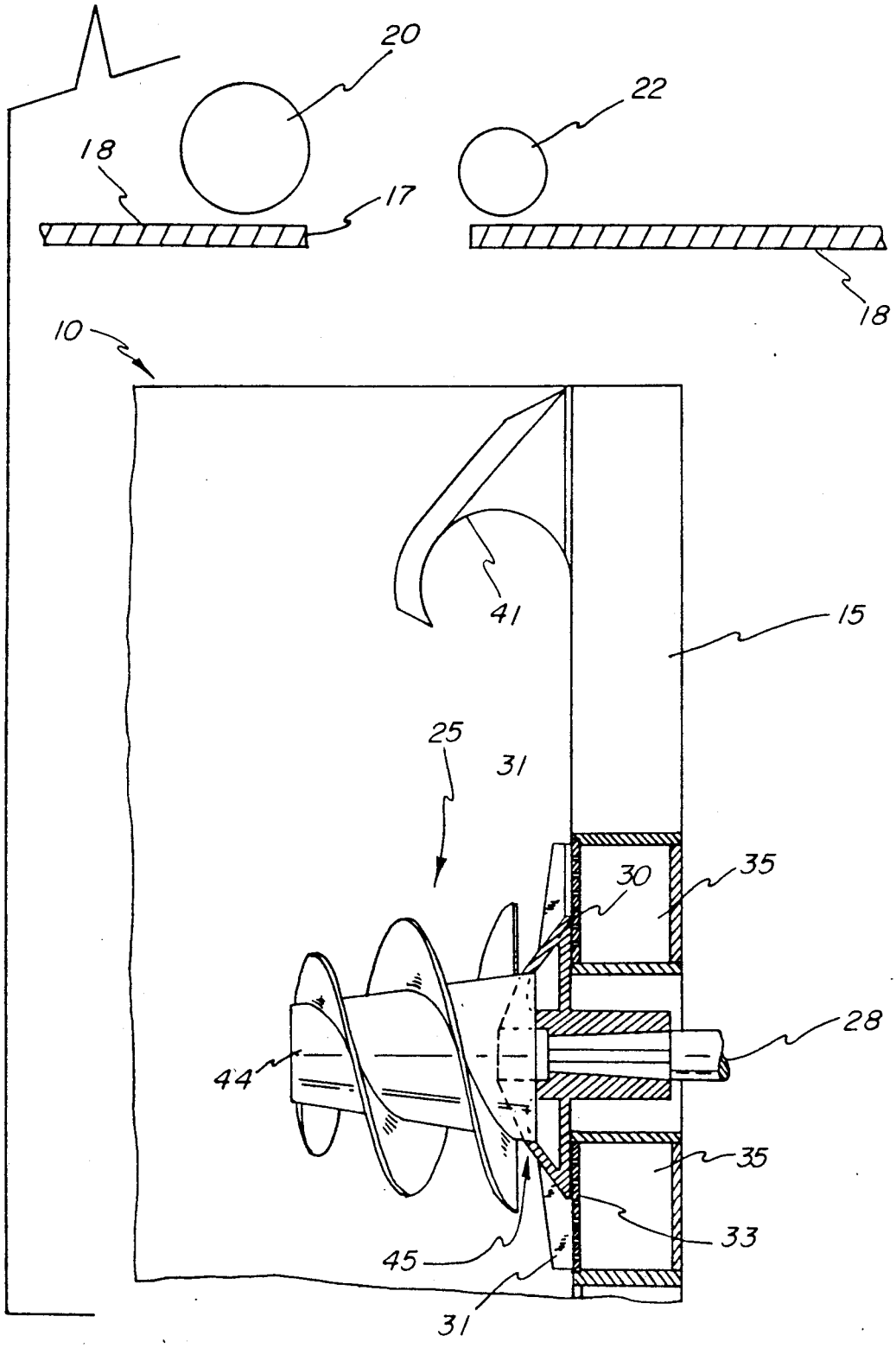
FIG. 2 is a section on an enlarged scale taken on the line 2—2 in FIG. 1.

The pulper shown in FIGS. 1 and 2 comprises an elongated tub indicated generally at 10 which is composed of a bottom wall 11, semi-cylindrical end walls 12 and 13, and straight vertical side walls 14 and 15 in parallel and more closely spaced relation than the end walls and of sufficient length to provide the tub 10 with a length sufficient to span the width of a Fourdrinier paper machine under which it is mounted. Thus in FIG. 2, the tub 10 is shown as located below a slot 17 in the floor 18 supporting a paper machine which includes a dryer drum 20 and the bottom roll 22 of a calendar stack positioned on opposite sides of the slot 17.

Two rotor assemblies 25 are rotatably mounted in the tub wall 15 on parallel horizontal shafts 26 supported in bearing housings 27 outside the tub 10, and each of shafts 26 is driven by a separate drive indicated diagrammatically at 28. In a preferred embodiment of the invention, each rotor assembly 25 comprises a rotor 30 of the construction disclosed in the above Vokes patent which includes pulping vanes 31. A perforated bed plate 33 is mounted in the wall 15 immediately behind each of the rotors 30 and forms the front of an annular extraction chamber 35, and each of these chambers 35 has an outlet 36 connecting with the same fitting 37 through which the pulped stock from both extraction chambers flows by way of a common pipe 38 to the next station in the system.

The rotors 30 are preferably driven in opposite directions such that the vanes 31 thereon move downwardly with respect to the space therebetween. The relative spacing of the rotor assemblies 25 is not critical. As an illustrative example, if the straight wall 15 is 114 inches long, the rotors 30 may be 32 inches in diameter and have their respective axes 70 inches apart.

Since these rotors impel the stock radially in all directions, the tub wall 15 may be equipped with a canopy 40 which extends between the end walls 12 and 13 and also projects horizontally from tub wall 15 a sufficient distance to overhang the rotors 30 so that its curved undersurface 41 will intercept stock impelled upwardly and redirect it downwardly in the tub. Satisfactory results in this respect have been obtained with rotors 30 having an axial dimension of approximately 5 inches if the canopy 40 has an inner horizontal dimension of 16 inches.

The construction of the pulper as described up to this point has been conventional for some years prior to the present invention, and as stated hereinabove, problems have been encountered using this construction of pulper with relatively stiff or dry broke because the broke tends to pile up on the surface of the liquid in the tub 10 rather than being submerged therein. In accordance with the present invention, this problem has been successfully overcome by addition to each rotor 30 of a feed screw 44 proportioned as shown in FIG. 1 and preferably of the structural and operational characteristics disclosed in Chupka U.S. Pat. No. 4,725,007 of 1988. Screw 44 may be secured to rotor 30 in any desired way, as by welding thereto at 45.

The pulping apparatus disclosed in that Chupka patent was particularly designed to handle high consistency stock, and for that purpose, it was found preferable to utilize a feed screw of approximately the same axial height as the diameter of the rotor. For the purposes of the present invention, the feed screws 44 do not necessarily require such lengths, but in a pulper tub equipped with a canopy 40, the feed screws 44 should be dimensioned to extend substantially beyond the vertical projection of the outer edge of the canopy. For example, with a canopy 40 having a maximum horizontal dimension of 16 inches, and with the tub 10 being 7 ft. wide between its side walls 14 and 15, each screw 44 should extend at least about 12 inches beyond the outer edge of the canopy 40.

The purpose and operating characteristics of the screws 44 in the practice of the present invention are different from the conditions in pulpers according to the above Chupka patent, wherein the feed screw operates to force high consistency pulp down to the vanes on the rotor. In the practice of the present invention, the problem is not the pulping of high consistency stock but, as noted above, assuring that broke will be drawn into the operating range of the rotor or rotors as fast as it is generated on the paper machine.

Relatively dry or stiff broke will normally tend to pile up on top of the liquid level in the tub, but in the practice of the invention, the screws 44 initially set up currents in the liquid within the tub which tend to draw the broke downwardly to the rotors. Then as soon as this action has been initiated on the leading end of the broke, the screws 44 have a mechanical action on the broke, in that they draw the broke to the pulping vanes on their associated rotors and thus promote the rapid pulping action which is necessary in order to assure that the extraction of adequately pulped broke will be at a volumetric rate substantially matching the rate at which fresh broke is being fed into the tub.

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. Apparatus for pulping a web of broke advancing downwardly thereto, comprising:

(a) an open tub having a bottom wall, end walls and generally vertical side walls which are substantially straight and are more closely spaced than said end walls to impart an elongated shaped to said tub, (b) at least one pulping rotor having a maximum axial dimension mounted for rotation on a substantially horizontal axis in one of said side walls, (c) means for driving each said rotor, and (d) a screw of an axial length substantially greater than the maximum axial dimension of each said rotor mounted concentrically on each said rotor and extending horizontally therefrom into the interior of said tub to engage a web of broke entering said tub from above and thereby to draw such web into engagement with the associated said rotor and (e) means on said one side wall forming a canopy extending lengthwise of said wall above each said rotor and projecting outwardly from said one side wall for a predetermined maximum horizontal distance greater than the axial dimension of each said rotor into overhanging relation with each said rotor to intercept liquid impelled upwardly by each said rotor, and further characterized in that said screw mounted on each said rotor is of an axial length greater than said predetermined maximum horizontal projection of said canopy and is structured and arranged such that each said screw will engage a sheet of broke descending in said tub past said canopy.

2. Pulping apparatus as defined in claim 1 wherein two of said rotors are mounted on said one side wall in horizontally spaced relation.

3. Pulping apparatus as defined in claim 1 wherein two of said rotors are mounted on said side wall in horizontally spaced relation, and said canopy extends the full length of said one side wall.

* * * * *